United States Patent [19]

Spies

[11] Patent Number: 4,620,651

[45] Date of Patent: Nov. 4, 1986

[54] CLOTHES HANGER WITH CONCEALABLE STORAGE COMPARTMENT

[76] Inventor: Mary A. Spies, 205 S. 54th, Space 54, Springfield, Oreg. 97478

[21] Appl. No.: 549,885

[22] Filed: Nov. 9, 1983

[51] Int. Cl.[4] ..... A47G 25/16; A47G 25/28

[52] U.S. Cl. ..... 223/88; 223/85

[58] Field of Search ..... 223/85-91, 223/92-98, DIG. 1-DIG. 4, DIG. 6; D6/315-328; 211/113, 116; 248/318; 206/284, 288, 289

[56] References Cited

U.S. PATENT DOCUMENTS

| | | | |
|---|---|---|---|
| D. 167,836 | 9/1952 | Kandarian | 223/85 |
| 884,617 | 4/1908 | Schlang | 223/86 |
| 956,141 | 4/1910 | McCorthy | 223/86 |
| 1,982,166 | 11/1934 | Hultquist | 223/91 |
| 2,085,138 | 6/1937 | Zetlin | 223/86 |
| 2,681,754 | 6/1954 | Lefton et al. | 223/86 |
| 3,790,044 | 2/1974 | Verdile | 223/86 |

FOREIGN PATENT DOCUMENTS 1548320 6/1967 France .

*Primary Examiner*—Robert R. Mackey
*Assistant Examiner*—Joseph S. Machuga
*Attorney, Agent, or Firm*—James D. Givnan, Jr.

[57] ABSTRACT

A clothes hanger having an arch portion fitted with a pivoted hook and having a housing extending lengthwise of the arch portion and in which valuables may be stored in a concealed manner. The housing is of a cross sectional dimension substantially corresponding to a like dimension of the arch portion for purposes of inconspicuous housing concealment beneath a hanger supported garment.

3 Claims, 3 Drawing Figures

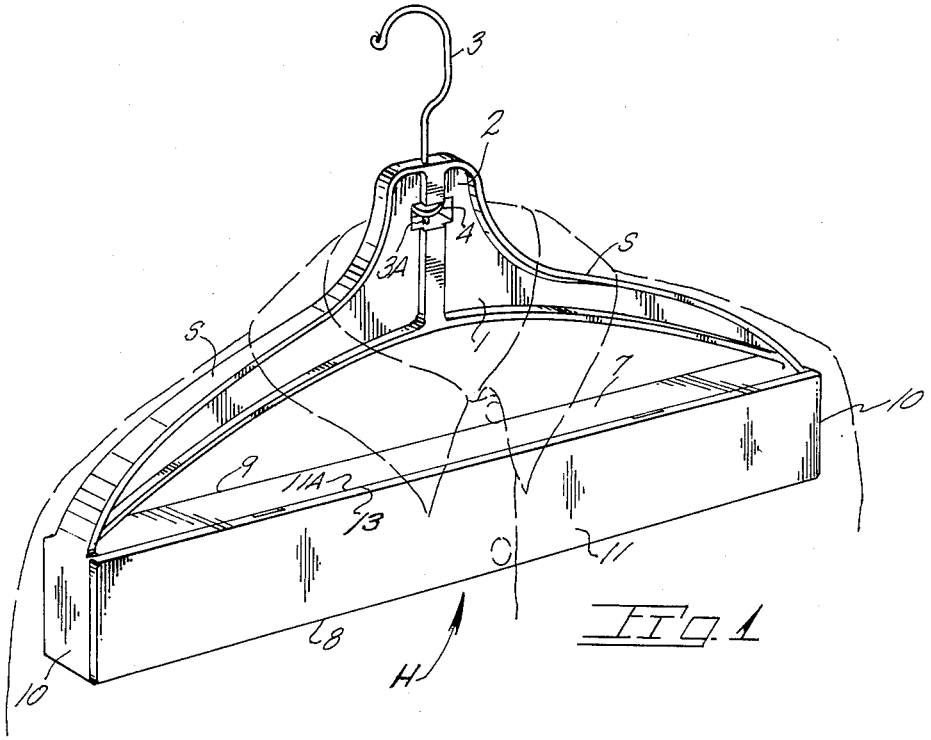
FIG. 1
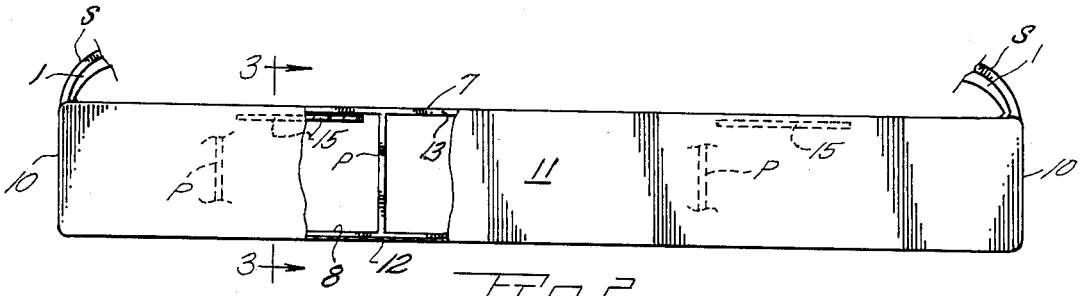
FIG. 2
FIG. 3
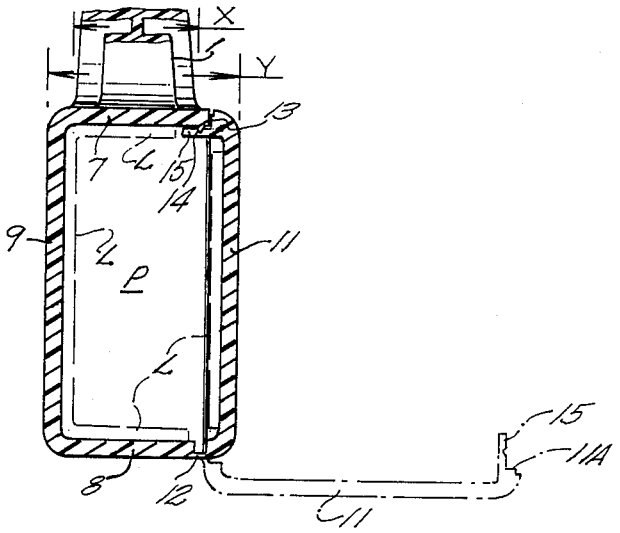

CLOTHES HANGER WITH CONCEALABLE STORAGE COMPARTMENT

BACKGROUND OF THE INVENTION

The present invention pertains to clothes hangers and particularly to a hanger including a compartment within which valuable articles may be stored in a concealed manner. Conventional clothes hangers serve but one purpose. While the prior art includes hanger disclosures having some type of storage capability, the same are not intended to render an ordinary appearance when in use. Known prior art clothes hangers do not provide a concealable storage area within which may be stored valuables such as jewelry, small keepsakes, money, etc.

Examples of the prior art include French Pat. No. 1,548,320 which shows a clothes hanger having a clothes storage compartment formed in the arch portion of the hanger. U.S. Pat. No. 3,790,044 shows a clothes hanger defining a storage area at the hanger neck for the reception of insect repellants. U.S. Pat. No. 2,085,138 shows a garment hanger having a cylindrical compartment in which fumigating material may be deposited. U.S. Pat. No. 1,982,166 discloses a lockable box suspended from a hanger for personal effects which box is supported by chain segements.

SUMMARY OF THE PRESENT INVENTION

The present invention is embodied within a clothes hanger having an inconspicuous storage compartment shaped so as to render a conventional shape to clothes hung thereon.

The instant hanger has a hook equipped arch portion and a housing which extends lengthwise of the arch portion. The housing is of slim cross section so as to avoid imparting other than an ordinary configuration to a closing article supported thereon. Accordingly when in place within a closet and draped with an article of clothing the latter has a typical, inconspicuous appearance to avoid arousing the interest of an intruder. Further, the exposed arch portion of the hanger is of conventional appearance to further contribute to the hanger's inconspicuous appearance. The use of a clothes hanger for storing valuables, even if suspected by the intruder, would necessitate the stripping of clothing from each hanger, a time consuming task not likely to be performed.

Important objectives include the provision of a clothes hanger having a concealed compartment therein covered by the garment in place on the hanger; the provision of a clothes hanger of a configuration so as to resemble a conventional clothes hanger when in use; the provision of a clothes hanger having an arch portion and a compartment of like transverse dimension so as to avoid imparting a bulky, and hence unorthodox appearance to an article of clothing stored thereon; the provision of a hanger having a storage compartment with a closure therefore having the appearance of and simulating a housing wall.

BRIEF DESCRIPTION OF THE DRAWING

In the accompanying drawing:

FIG. 1 is a perspective view of the present clothes hanger with an article of clothing thereon shown in phantom lines;

FIG. 2 is a front elevational view of the clothes hanger with the arch portion broken away, and FIG. 3 is a vertical, sectional view taken along line 3—3 of FIG. 2.

DETAILED DESCRIPTION OF THE PREFERRED EMBODIMENT

With continuing reference to the drawing, wherein applied reference numerals indicate parts hereinafter smilarly identified, the reference numeral 1 indicates an arch portion of the present hanger which is of molded contruction.

The arch portion includes a neck 2 in which is permanently secured a hook 3 for placement on a clothes closet rod. A washer at 4 is in place on a hook stem 3A and carries the hanger and garment weight. An uppermost edge surface S of the hanger constitutes a garment supporting surface and is of a transverse dimension not unlike the arch portion of better quality wooden or molded hangers for more garment supporting area.

The hanger includes a housing indicated generally at H located horizontally and supported by the ends of the arch portion. Housing top and bottom walls are at 7 and 8 while a rear wall is at 9. End walls are at 10. Closure means at 11 is shown as a door supported in a positionable manner by a reduced, flexible web 12 (FIG. 3) also integral with bottom wall 8. Closure 11 has a perimeter 11A which engages the housing perimetrical edge at 13 in a flush manner without gaps to render the appearance of a housing wall member.

Further contributing to the inconspicuous nature of the hanger housing is its cross sectional or transverse dimension at Y (FIG. 3) which varies only slightly from the adjacent arch extremity transverse dimension as indicated at X. Accordingly, the garment hung on the hanger would have the shape or appearance of a garment in place on a conventional molded or wooden hanger. A suitable hanger embodying the present invention may have dimensions of X and Y of one and one-quarter and three quarters of an inch.

A suitable material for molding the present hanger is polypropylene with the web 12 being flexible by reason of its reduced thickness of about 0.015 of an inch.

A liner L is preferably applied to the housing interior which liner is of a resilient nature to prevent detection of the stored articles by shaking the hanger.

The hanger closure is held closed by lips 15 which project outwardly from the closure to engage a ridge 14 on the underside of top wall 7 of the housing. Accordingly, the closure is held flush with the housing walls.

Partitions at P are located at intervals along the housing and are provided with segments of the housing liner at L.

Housing H is of a narrow cross sectional configuration to permit it to serve in the usual manner of a hanger cross-member, i.e., to support various articles of clothing folded thereover.

While I have shown but one embodiment of the invention it will be apparent to those skilled in the art that the invention may be embodied still otherwise without departing from the spirit and scope of the invention.

Having thus described the invention, what is desired to be secured under a Letters Patent is:

I claim:

1. A clothes hanger additionally serving to store in a concealed manner small valuables and comprising, an arch portion including a neck, a hook centrally carried by the neck of the arch portion, a horizontal housing having a multitude of fixed walls and carried by arch portion extremities and being of elongate configuration and integral at its ends with the extremities of said arch portion, said housing defining a storage area substantially coextensive with said arch portion for the reception of small valuables, said housing including closure means movably mounted on one of said fixed walls and being of planar configuration and coextensive with said fixed walls so as to resemble a fixed wall of the housing, and said housing being of a horizontal transverse dimension Y and varies only slightly from the greatest transverse dimension X of the extremities of said arch portion whereby said housing will cause a garment and hanger combination to have the typical appearance of a garment in place on a conventional clothes hanger.

2. The clothes hanger claimed in claim 1 wherein said closure means is a door terminating at its edges flush with the outer surface of certain housing walls.

3. The clothes hanger claimed in claim 2 wherein said housing constitutes a hanger crossmember over which various articles of clothing may be folded.

* * * * *